US009508228B2

(12) United States Patent
Kirnstötter

(10) Patent No.: US 9,508,228 B2
(45) Date of Patent: Nov. 29, 2016

(54) MULTIPLAYER GAMING SYSTEM

(71) Applicant: NOVOMATIC AG, Gumpoldskirchen (AT)

(72) Inventor: Florian Kirnstötter, Vienna (AT)

(73) Assignee: NOVOMATIC AG, Gumpoldskirchen (AT)

( * ) Notice: Subject to any disclaimer, the term of this patent is extended or adjusted under 35 U.S.C. 154(b) by 0 days.

(21) Appl. No.: 14/286,448

(22) Filed: May 23, 2014

(65) Prior Publication Data

US 2014/0256398 A1 Sep. 11, 2014

Related U.S. Application Data

(63) Continuation of application No. PCT/EP2012/004855, filed on Nov. 23, 2012.

(51) Int. Cl.
*G07F 17/32* (2006.01)

(52) U.S. Cl.
CPC ..... *G07F 17/3286* (2013.01); *G07F 17/3262* (2013.01)

(58) Field of Classification Search
CPC ..... A63F 13/00
See application file for complete search history.

(56) References Cited

U.S. PATENT DOCUMENTS 5,588,650 A 12/1996 Eman et al.
2005/0003885 A1* 1/2005 Rhoten ..... 463/17
2005/0014550 A1* 1/2005 Rhoten ..... 463/17
2009/0258696 A1* 10/2009 Chim ..... G07F 17/32 463/20
2010/0124966 A1* 5/2010 Kido ..... 463/17
2010/0144419 A1* 6/2010 Miltenberger et al. ..... 463/17
2010/0210337 A1* 8/2010 Okada ..... 463/16
2012/0034968 A1* 2/2012 Watkins et al. ..... 463/20
2012/0077569 A1* 3/2012 Watkins et al. ..... 463/25

FOREIGN PATENT DOCUMENTS

WO WO 2013/075838 5/2013

* cited by examiner

*Primary Examiner* — Jason Skaarup
(74) *Attorney, Agent, or Firm* — Levine Bagade Han LLP

(57) ABSTRACT

The present invention generally relates to gaming systems for playing ball games where a ball is launched into a gaming area. More particularly, the present invention relates to a multiplayer gaming system comprising a ball game device having a launching mechanism for launching a ball into a gaming area to start a game, the gaming system further comprising a start control means for controlling start of the launching mechanism and a plurality of gaming terminals for a plurality of players, said gaming terminals including an input device for inputting a prediction and/or a bet for the outcome of a game. In accordance with the present invention, the input device of each gaming terminal includes start signal input means for inputting a start signal for starting the launching mechanism, wherein the start control means of the gaming system includes a random signal generator for randomly selecting one of the plurality of gaming terminals for each game to generate the start signal and a display signal generator for generating a display signal indicative of the gaming terminal selected for the generation of the start signal.

10 Claims, 5 Drawing Sheets

MULTIPLAYER GAMING SYSTEM

CROSS-REFERENCE TO RELATED APPLICATIONS

The present application is a continuation of PCT Application No. PCT/EP2012/004855, filed Nov. 23, 2012, which claims the benefit of British Patent Application No. 1120211.6, filed on Nov. 23, 2011, both of which are incorporated by reference herein in their entireties.

BACKGROUND

The present invention generally relates to gaming systems for playing ball games where a ball is launched into a gaming area. More particularly, the present invention relates to a multiplayer gaming system comprising a ball game device having a launching mechanism for launching a ball into a gaming area to start a game, the gaming system further comprising a start control means for controlling start of the launching mechanism and a plurality of gaming terminals for a plurality of players, said gaming terminals including an input device for inputting a prediction and/or a bet for the outcome of a game, wherein the input device of at least some of the gaming terminals includes start signal input means for inputting a start signal for starting the launching mechanism.

In certain ball games such as roulette or pachinko, a ball may roll on a gaming area and the outcome of a game is determined by the section of the gaming area where the ball stops. Depending upon where the ball stops, a player may win or lose a bet or a prediction where such bets and predictions may include wagering money or not. For example, in case of roulette, the gaming area may include a spinning wheel having a ring of pockets or landings, wherein a ball may be launched onto the spinning wheel, typically in the direction opposite to the direction of rotation of the spinning wheel. The bet or prediction outcomes are based on which landing is the stopping place of the ball.

In such ball games, the launch of the ball into the gaming area may have some relevance to the outcome of the game, wherein launching speed and launching direction may have influence as well as the point of time at which the ball is launched since such point of time affects the launching position of the ball relative to the spinning wheel. Consequently, such launching action needs to be effected in a secure and trustworthy way so as to avoid increased occurrence of certain outcomes and to establish players' confidence in the system. Aside from such safety and manipulation aspects, there is also a continuous need to increase the level of interest, excitement and volatility associated with playing such ball games.

In order to avoid the very basic shortcomings and undue effects of manually launching the ball onto the rotor, it already has been suggested to use automatic launching mechanisms which may launch the ball into the gaining area semi-automatically, e.g. upon pushing a start button, or fully automatically, e.g. upon expiration of a certain time frame. Such launching mechanisms may use various ball actuators such as spring-biased actuation or pressurized air. For example, document US 2005/0003885 discloses a roulette game system including an energizable launch device to provide the launching of the ball. A remote transmitter is controlled by a push button which may generate a start game signal that is then transmitted to an electronic random time delay circuit that is capable of energizing the launch mechanism at a random time delay after it has itself been energized.

Furthermore, US 2010/0124966 discloses a roulette game system wherein the ball may be launched by means of applying an accelerating force to the ball by air discharged from discharge openings provided in an edge portion of the gaming area. Starting and stopping the discharge of the pressurized air is controlled by a timer, wherein bet end timing is set through an external operation by staff in a game hall or a controller so as to make sure that it is impossible or at least to add difficulty to predict a location at which the ball falls.

Furthermore, document US 2010/0144419 discloses a multiplayer roulette game system which enables a plurality of players to simultaneously place bets. In operation, each player places one or more bets using a wager station adjacent to the wheel assembly of the roulette game system. After all bets are placed, a dealer spins the wheel and launches the ball to start the game.

Document U.S. Pat. No. 5,588,650 discloses an automated roulette device with a plurality of player's consoles which are provided with ball launch control buttons for controlling the speed and moment of release of a ball onto the spinning roulette wheel. The player whose turn it is to release the ball, is determined in accordance with a predetermined pattern, wherein a panel of the console of the player whose turn it is to release the ball, is illuminated so as to signal to the player s/he may start the game. However, such game starting routing may be anticipated by players after some rounds of playing and/or by means of watching other players' consoles, thus creating opportunity to manipulate the starting process and reducing the game's unpredictability.

Furthermore, document US 2010/0210337 A1 discloses a game system including a plurality of slot machines which may switch to a roulette game when a combination of bonus symbols stop in a winning line, wherein other slot machines may participate in a second game played on a separate second game device when such switching to the roulette game occurs.

SUMMARY OF THE INVENTION

It is a general objective underlying the present invention to provide for an improved multiplayer gaming system avoiding disadvantages of the prior art and achieving improved functionality. Another more particular objective underlying the present invention is to provide for an improved multiplayer ball game system having an increased security against manipulation and providing for a reliably variable launching of the ball into the gaming area. Another particular objective underlying the invention is to provide for an improved multiplayer gaming system that adds difficulty to predict a location where the ball will fall. Finally, it is also desired to increase the level of interest, excitement and volatility associated with playing the game.

According to the present invention, such objective is achieved by a multiplayer gaming system as defined in claim 1. Preferred embodiments of the invention are laid down in the dependent claims.

More particularly, to achieve at least one of the aforementioned objectives, the pre sent invention provides for use of various ones of the gaming terminals for starting the ball launch procedure and to allow for variation of the ball launch procedure by means of variation of the respective one of the gaming terminals that may initiate a respective game. In accordance with the present invention, the input device of each gaming terminal includes start signal input means for inputting a start signal for starting the launching mechanism, wherein the start control means of the gaming system includes a selector for variably selecting one of the plurality of gaming terminals for each game to generate the start signal and a display signal generator for generating a display signal indicative of the gaming terminal selected for the generation of the start signal. The selector includes a random signal generator for randomly selecting the gaming terminals for the generation of the start signal. For example, a random number generator may be provided for generating random numbers and selecting a respective one of the gaming terminals on the basis of numbers associated therewith. Depending on the random signal, for each game, another one of the gaming terminals may be selected, wherein it is also possible to have one gaming terminal selected for two, three or more consecutive games to generate the respective start signals and to change the gaming terminal for generation of the start signal after two, three or more consecutive games. For example, the random signal generator may select another gaming terminal each second game or each third game to generate the start signals, wherein, however, it is also possible to vary the number of consecutive games after which another one of the gaming terminals is selected for generation of the start signal.

The aforementioned start signal input means may be provided immediately at a respective gaming terminal, for example in terms of a push button or touch screen field forming part of the input device of the respective gaming terminal. Such input means may be fixedly connected to the gaming terminal or, in the alternative, or in addition, such start signal input means may include remote control means such as a foot pedal or a hand control unit that can be actuated by a player standing in front of the respective gaming terminal.

The selection of the respective one of the gaming terminal for the respective game may be effected in different modes, wherein it is preferably effected in such a way that for a predetermined number of games, which number is preferably sufficiently large, a uniform distribution over the gaming terminals is provided, that is to say each of the gaming terminals is selected a comparable number of times for being enabled for the generation of the start signal. In accordance with an alternative starting or selecting mode, which mode may be available in addition to the random signal selection mode, the selector may include a logic unit for automatically selecting the gaming terminal for the generation of the start signal in accordance with a predetermined logical function. For example, a very basic embodiment of such function may provide for selecting another gaming terminal for each game in accordance with a predetermined order. For example, a first terminal may be selected for a first game, a second terminal may be selected for a second game, a third terminal may be selected for a third game etc., wherein the first terminal may be selected again after each terminal has been selected once.

In accordance with a preferred embodiment of the invention, all gaming terminals of the gaming system may be selected for the generation of the start signal to initiate the launching process so that each player has the option of being selected for generating the start signal. In the alternative, it is also possible in accordance with another embodiment of the invention that the plurality of gaming terminals which are able to be selected for the generation of the start signal are only a subgroup of the entire number of gaming terminals of the gaming system. For example, a plurality of master gaming terminals may be used for the selection procedure leading to the generation of the start signal whereas at least one secondary gaming terminal may not be allowed to generate the start signal. Choosing a subgroup of all gaming terminals for the aforementioned selection process can be advantageous in particular when one or more gaming terminals are not attended by any player what may be determined on the basis of the status of the gaming terminals and/or the status of predictions and/or bets made on the respective gaming terminals. For example, gaming terminals where no bets or predictions have been entered may be disregarded. In the alternative or in addition, choosing a subgroup of all terminals for the aforementioned selection process also can be made on the basis of other criteria such as a number of bonus games or the amount of the bet placed so that a respective terminal may qualify for being selected when a sufficiently high bet was entered.

In addition to using a random number generator for selecting the starter terminal and/or the aforementioned determination of a subgroup for the selection process, other criteria can be taken into account for the selection of the gaming terminal to be enabled to generate the start signal. For example, the selector may select the terminal at which the highest wager or the lowest wager has been made for the game to be started. In the alternative, the terminal at which the highest win occurred during a preceding game can be selected for the generation of the start signal. On the other hand, it is also possible to select the gaming terminal which did not have any win in the preceding game or did have the lowest win in the last game or for a predetermined number of preceding games. In the alternative, the selector may select the terminal having the highest amount stored in its credit storage. Other criteria using information provided by the game controller can be considered for the selection process.

Such criteria as mentioned before also may be used in combination with the afore mentioned random number generation and/or in combination with the aforementioned subgrouping of the terminals. For example, the selector may determine the terminal that made the highest win in the preceding game, the terminal that made the lowest win in the preceding game and the terminal at which the highest wager has been made for the game to be started. Then the random number generator may select one of these three gaming terminals that were predetermined on the basis of the aforementioned criteria.

So as to make a player aware of the fact that s/he has been selected and is entitled to generate the start signal, a respective display signal is generated to indicate the outcome of the selection process. Such display signal may be displayed at different locations, wherein e.g. a central screen may be used to indicate the number of the gaming terminal where the start signal can be generated. In the alternative or in addition to such central display, the display signal indicative of the selected gaming terminal can be displayed directly at the selected gaming terminal. The gaming terminals may include display means that are responsive to the aforementioned display signal so that upon selection of the respective gaming terminal, the selected gaming terminal displays a signal indicating to the player that s/he may enter the start signal. Such display means may include visual or acoustic devices, wherein in accordance with an embodiment of the invention a display such as a monitor may be provided so as to display the invitation to enter the start signal. Such invitation may be a text message or any other symbol displayed on the monitor. In addition or in the alternative, the start signal input means may be provided with light signaling means for displaying a light signal, e.g. a flashing light indicating that the start signal input means are ready to be operated respectively the terminal is enabled for the generation of the start signal.

The aforementioned display signal indicative of the selected gaming terminal may be generated immediately upon having effected the selection of the gaming terminal for the generation of the signal. In the alternative, the said display signal indicating the outcome of the selection can be delayed and provided a certain time period after having effected the selection. Such delay allows for an early selection of the "next" gaming terminal, for example already during a preceding game or during bet time, thereby reducing downtimes and delays. On the other hand, the provision of the display signal may be controlled independently from the end of the selection procedures and/or on the basis of other criteria such as the time frame for placing bets and making predictions. For example, the display signal indicative of the selected gaming terminal may be controlled to occur and/or to be displayed immediately upon the end of the bet time.

As long as attention is given to the display signal indicative of the selected terminal, it is basically possible to have all start signal input means of all gaming terminals in the active and operative state. However, according to a preferred embodiment, measures are taken to prevent unselected gaming terminals from providing start signals by mistake or careless players. More particularly, the start control means may include a start signal processor for receiving and processing the start signals of all gaming terminals, wherein said start signal processor is adapted to identify the received starting signals in terms of a determination from which gaming terminal the respective signal comes from, and to forward only the starting signal of the one gaming terminal that was selected for generation of the starting signal and to disregard starting signals of unselected other gaming terminals.

In the alternative or in addition to such start signal identification and processing, the start signal input means of unselected gaming terminals may be deactivated and/or only the start signal input means of the selected gaming terminal may be activated. The start control means may include corresponding activating and/or deactivating means to effect activation and deactivation of the start signal input means. Such deactivator and/or such activator may be implemented on various sections of the system architecture, e.g., the gaming terminals themselves may be provided with such activating and/or deactivating means responsive to, e.g., the display signal indicative of the selected gaming terminal so as to effect activation and/or deactivation in response to the received display signal. Depending on the structure of the start signal input means, only activation or only deactivation may be provided, wherein e.g. only deactivation may be provided when the start signal input means are, in their basic status condition, active. In the alternative, the respective input means usually may be kept deactivated and only upon receipt of the respective selection signal the start signal input means of the selected gaining terminal may be activated.

The start signal provided by a selected gaming terminal may be used so as to immediately start the launching mechanism, wherein the launching mechanism may be adapted to be responsive immediately upon receipt of the starting signal. According to an alternative embodiment of the present invention, a certain time of delay may be provided between the generation of the start signal and indeed starting the launching process. In particular, according to an advantageous embodiment of the present invention, the start control means may include a random timeout delay for providing a random delay upon receipt of the start signal from the selected gaming terminal so as to activate the launching mechanism with a random delay upon receipt of the start signal from the selected gaming terminal. Such random delay circuit provides for a further increased variation of the starting process and thus a further increased safety and security against influences where the ball might stop.

According to a further preferred embodiment of the present invention, the start control means may be responsive to a timer device providing for a certain time frame for placing predictions and/or bets on the outcome of a game, wherein the selector is adapted to select the gaming terminal for the generation of a start signal at a predetermined point of time relative to said time frame and/or to generate the display signal indicative of the selected gaming terminal at a predetermined point of time relative to said time frame. For example, a gaming terminal may be selected for the generation of the start signal already during bet time, whereas the outcome of the selection process can be displayed immediately upon or a certain period of time after the end of the time frame for placing the bets.

The selection of the gaming terminals which may activate the launching mechanism may be effected at different sections of the system's architecture, wherein depending on the system architecture different modules may be provided with the different elements of the start control means such as the separator and the display signal generator. According to a preferred embodiment of the invention, the gaming system may include a game server that is provided between the gaming terminals and the ball game device, wherein such game server is, on the one hand, connectable to the gaming terminals and, on the other hand, to the ball game device. Such game server allows for convenient communication and coordination of the game terminals with the game device. In case such game server is present, the start control means, in particular the selector for selecting the game terminals and/or the display signal generator for generating the display signal indicative of a selected game terminal may be included in such game server or connectable to such game server. In particular, the game server may include a random signal generator for selecting the respective one of the gaming terminals for the generation of the start signal.

On the other hand, such game server is not necessarily part of the multiplayer game system. Depending on the capabilities of the ball game device, the game terminals may directly communicate with the game device.

If a game server is present or not, the elements of the start control means, in particular the selector and/or the display signal generator may be part of the ball game device or may be connected to the ball game device. In the alternative or in addition to such start control facilities at the ball game device, one or more of the gaming terminals may be provided with such start control means, wherein in particular the aforementioned selector and/or the aforementioned display signal generator may be included in or connectable to at least one of the gaming terminals. Provision of the said start control elements in a plurality of gaming terminals further increases the systems' architecture against central attacks against the central game server.

BRIEF DESCRIPTION OF THE DRAWINGS

In the following, the present invention is described in further detail on the basis of preferred embodiments in connection with corresponding drawings. In the drawings show.

DETAILED DESCRIPTION

Figure 2:
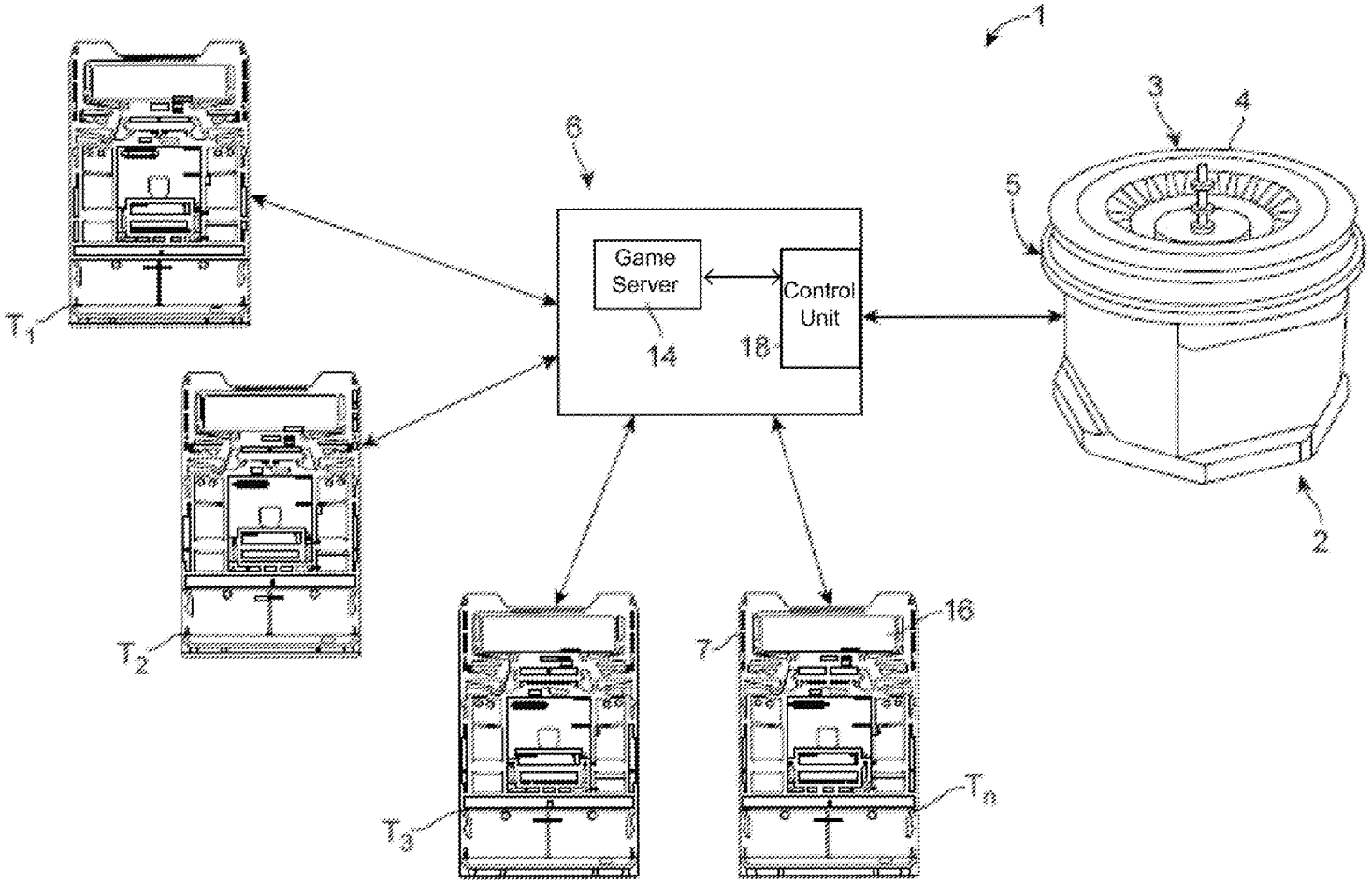
FIG. 2: a schematic overview of a multiplayer gaming system for playing roulette in accordance with a preferred embodiment of the invention showing a plurality of gaming terminals and a ball game device in terms of a roulette game device, wherein the gaming terminals are connectable to a control unit that is also connected to the ball game device.

As can be seen from FIG. 2, a ball game device 2 may be adapted to play the game of roulette. A gaming area 3 of the ball game device 2 may include a spinning wheel 4 which may be provided with a ring of pockets or landings in which a ball launched into the gaming area 3 may stop. As well-known from roulette games, such pockets or landings may be associated with numbers so that the number of the pocket where the ball stops is the winning number.

The ball game device 2 may be provided with a launching mechanism 5 for launching the ball semi-automatically into the gaming area 3, wherein a start control means 6 is provided for controlling the start of such launching mechanism 5.

The gaming system 1 further comprises a plurality of gaming terminals T1, T2, T3, Tn which may be standalone devices or may be part of a multi-user playing station. Each gaming terminal is provided with communication means so as to be able to communicate with the ball game device 2 either directly or indirectly via a game server as will be described.

Figure 1:
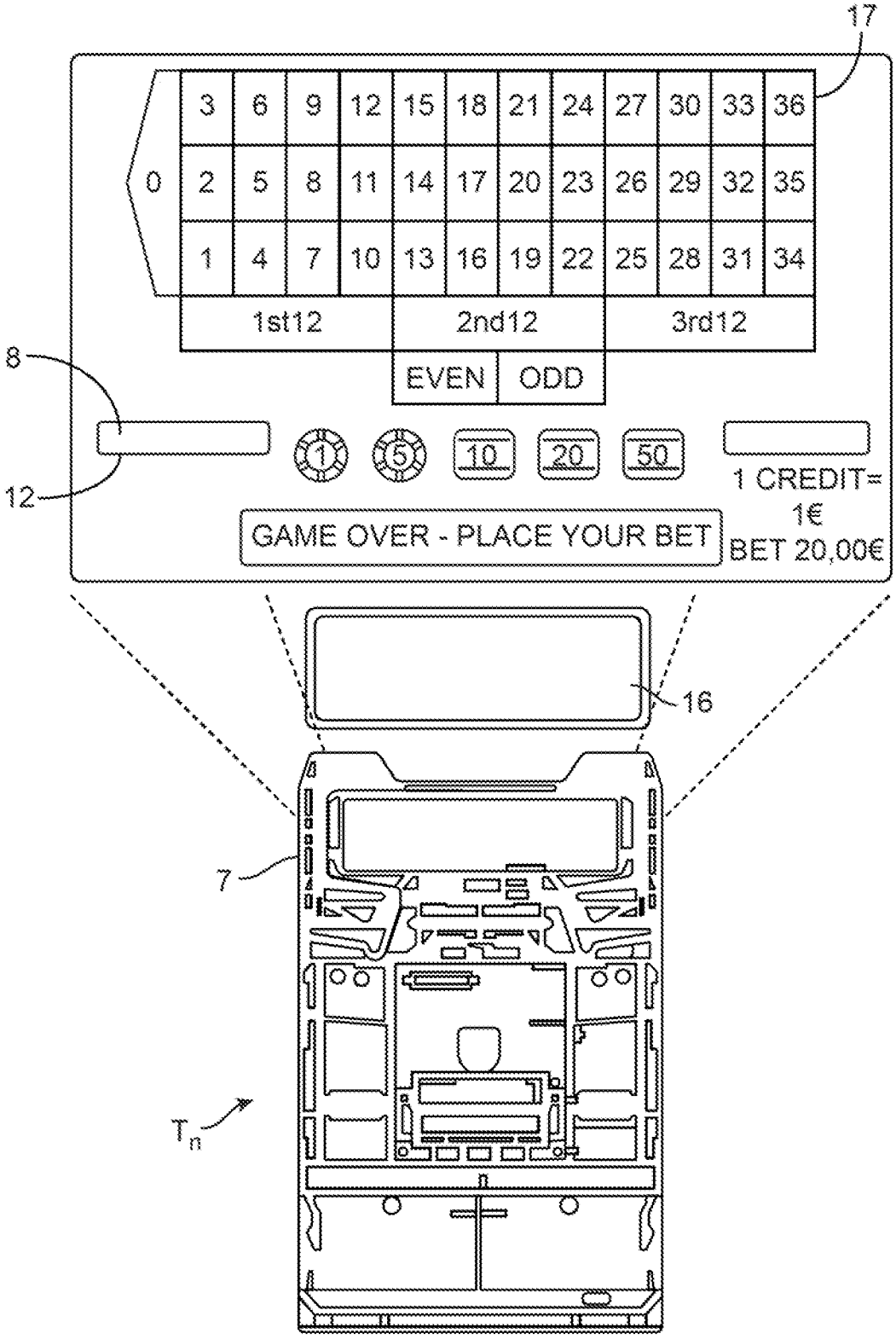
FIG. 1: a schematic view of a gaming terminal connectable to a multi-user gaming system for playing roulette in accordance with a preferred embodiment of the invention, wherein the gaming terminal's display is shown in an increased detailed view above the terminal.

As can be seen from FIG. 1, each gaming terminal T1, T2, T3 or Tn is provided with a display device 16 which may include a monitor, preferably in terms of a touch screen so as to display information relative to the ball game and/or information relative to placing bets and/or making predictions depending on whether the gaming system is playable with money or free of money.

In particular, as shown by FIG. 1, the screen of the display device 16 may be adapted to display a wagering field, sometimes referred to as the betting layout. Such wagering field 17 may include a template which specifies a grid of numbers and betting options, wherein the numbers in the grid may correspond to the numbers in the pockets of the spinning wheel 4. Each graphical wagering layout enables a player to select desired numbers and betting combinations for their wagers. For example, a touch screen may allow for identifying a desired amount of credit by means of touching the respective coin symbol and, e.g., in a second step to place such amount of money on a specific number, e.g., by means of touching the respective number in the grid of numbers.

Furthermore, as shown by FIG. 1, the display device 16 also may be used so as to display further information such as, e.g., the time frame for placing bets which, e.g., may include the invitation "Game over—place your bet" as shown in FIG. 1.

In addition to such input means, the input device 7 which may be implemented by the aforementioned touch screen, may include start signal input means 8 which may be implemented by a respective display symbol on the aforementioned touch screen. Such start signal input means 8 allows for inputting a start signal at the touch screen of the gaming terminal.

Which terminal is allowed to generate such start signal is determined by the start control means 6 which may include a respective selector 9 for selecting one of the gaming terminals for generating the start signal of a respective game.

Figure 3:
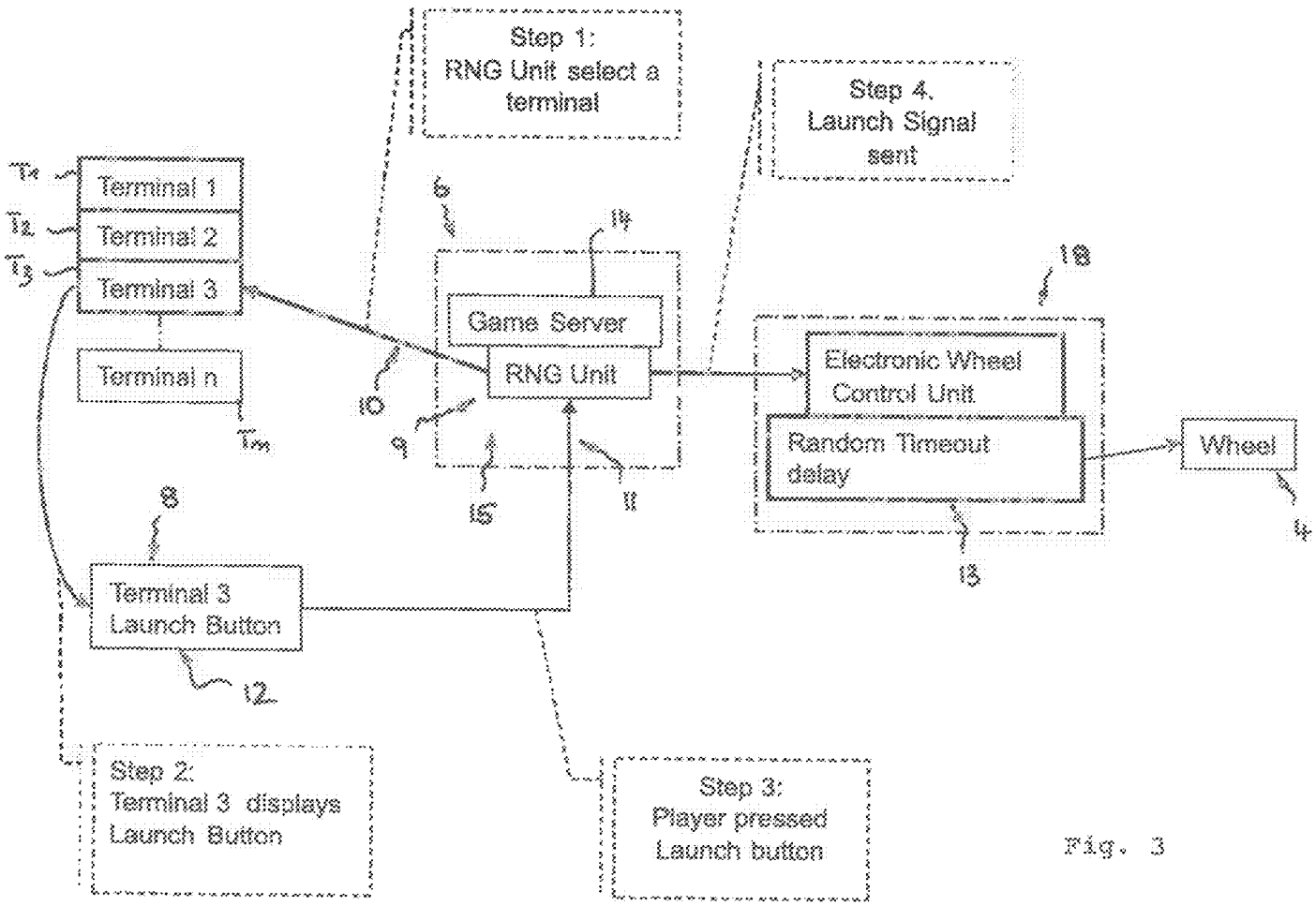
FIG. 3: a schematic view of the system architecture of the gaming system of FIG. 2 in accordance with a first preferred embodiment of the invention, wherein a game server is provided between the gaming terminals and the control unit for the gaming device, wherein the game server is provided with a random number generator for randomly selecting the game terminals for the generation of the start signals.

As shown by FIG. 3, such start control means 6 may be implemented in a game server 14 which may be provided between the launching mechanism 5 of the ball game device 2 and the gaming terminals T1, T2, T3, Tn. More particularly, as shown by FIG. 3, the game server 14 may be provided with or connected to a random number generator RNG which randomly provides for numbers that corresponds to numbers associated to the respective gaming terminals. For example, if there are gaming terminals T1, T2, T3, Tn, the random number generator RNG randomly issues one of the numbers T1, T2, T3, Tn.

As can be seen from FIG. 3, in a first step the selector 9 being provided with the aforementioned random signal generator RNG selects in a first step one of the gaming terminals to be enabled for generation of the start signal, wherein in the example of FIG. 3 terminal number 3 is selected.

As shown by FIG. 3, such invitation respectively enablement to enter the start signal may be implemented in terms of displaying a launch button on the touch screen of the gaming terminal T3 in a step 2 subsequent the aforementioned step 1. For example, the launch button may be displayed by display means 12 in terms of a blinking light so that the player realizes s/he now may push the launch button.

Entering the start signal is then step 3 of the launch procedure. Upon pressing the displayed launch button, the gaming terminal 3 sends a start signal to the game server 14 which, upon receipt of such start signal forwards the signal to the launching mechanism 5 of the ball game device 2.

The launching mechanism 5 may immediately start launching the ball into the gaming area or, in the alternative, may provide for a random timeout delay so as to start the launching process with a certain delay upon receipt of the start signal.

Figure 4:
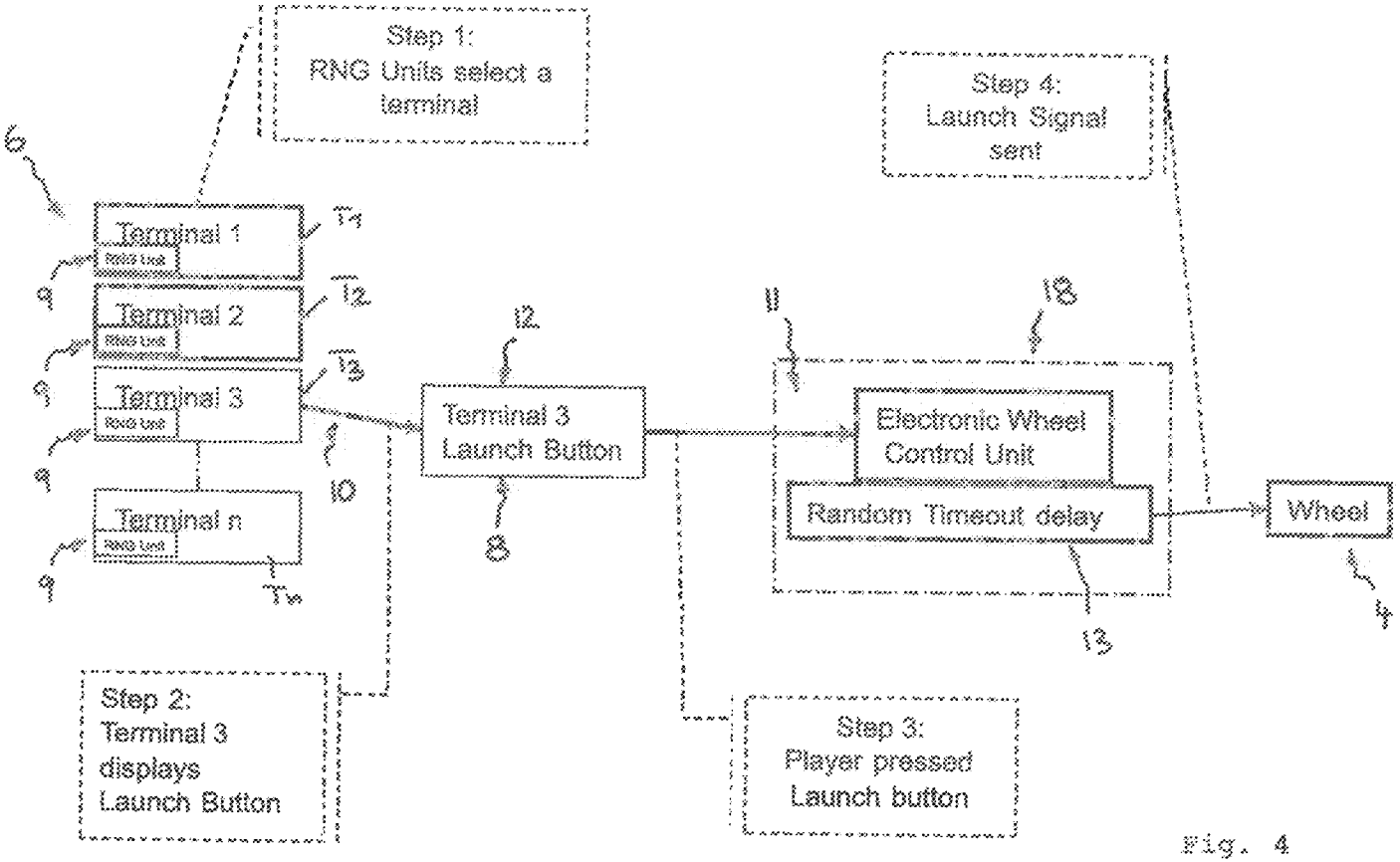
FIG. 4: a schematic view of the system architecture of the gaming system of FIG. 2 according to a further preferred embodiment of the invention, wherein the terminals are directly communicating with the control unit for controlling the game device, wherein the game terminals are provided with random number generators for selecting a terminal to provide for the launch signal.

As can be seen from FIG. 4, use of a game server 14 provided between the ball game device 2 and the gaming terminals is not necessary, but the gaming terminals T1, T2, T3, Tn may directly communicate with the ball game device 2.

Furthermore, as FIG. 4 shows, the start control means 6 may be implemented in at least one of the gaming terminals, wherein preferably each gaming terminal T1, T2, T3, Tn may be provided with a selector 9 including a random signal generator RNG so that the selection of a respective one of the gaming terminals for the generation of the start signal can be effected by the gaming terminals themselves. Preferably, the gaming terminals may communicate with each other so as to control the selection process.

In FIG. 4 again terminal number 3 is selected for providing the start signal so that the display device 16 of the gaming terminal T3 again may display a launch button to invite the player to enter the launch signal. Upon touching the launch button at terminal 3, said terminal 3 send a start signal directly to the ball game device 2 or the control unit 18 connected thereto so as to activate the launching mechanism 5.

Figure 5:
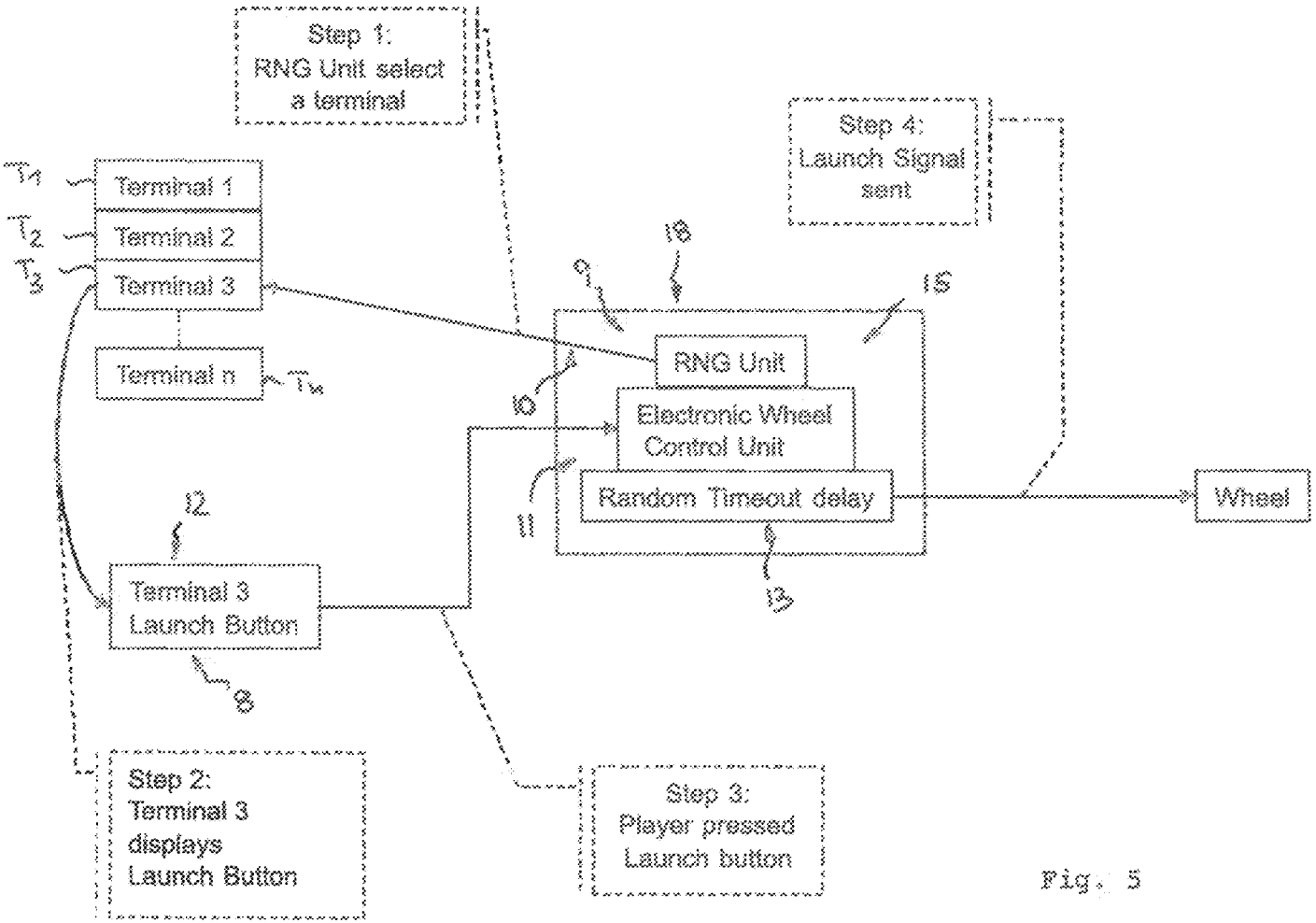
FIG. 5: a schematic view of the system architecture of the gaming system of FIG. 2 according to a still further preferred embodiment of the invention, wherein the control unit of the ball game device is provided with a random number generator for randomly selecting the gaming terminals.

In a still further embodiment that is shown in FIG. 5, the start control means 6 may be implemented in the control unit 18 associated with the ball game device 2. In particular, the control unit 18 of the ball game device 2 may include a random number venerator RNG for randomly selecting one of the gaming terminals for the generation of the start signal. Aside from this difference in the system's architecture, the embodiment of FIG. 5 corresponds to FIG. 4 so that a corresponding launching procedure including the aforementioned steps 1-4 may be effected to start a game.

In addition to or in the alternative to such random number generator RNG, the selection of the gaining terminal to be enabled for generating the start signal may be effected on the basis of other selection criteria such as the highest or lowest wager made for the game to be started, the highest win made in the preceding game, the lowest win made in the preceding game, no win made in the preceding game or the highest amount stored in the credit storage of a terminal, wherein it is also possible to combine such selection criteria with a random number generator RNG. For example, the aforementioned criteria may be used so as to preselect a subgroup of terminals, wherein the random number generator RNG then selects one of the terminals of such predetermined subgroup for the generation of the start signal.

What is claimed is:

1. A multiplayer gaming system comprising:

a ball game device having a launching mechanism for launching a ball into a gaming area to start a game, the gaming system further comprising a start controller for controlling start of the launching mechanism and a plurality of gaming terminals for a plurality of players, the gaming terminals comprising an input device for inputting at least one of a prediction and a bet for an outcome of a game, wherein the input device of each gaming terminal comprises a start signal inputter for inputting a start signal for starting the launching mechanism, wherein the start controller comprises a random signal generator for randomly selecting at least one of the gaming terminals for enabling to generate the start signal and a display signal generator for generating a display signal indicative of the gaming terminal to be selected for the generation of the start signal, wherein the start controller is responsive to a timer device providing for a time frame for placing predictions and/or bets on the outcome of a game, wherein a selector is adapted to select the gaming terminal for the generation of the start signal at a predetermined first point of time within said time frame and wherein the display signal generator is adapted to control the display signal to occur and to be displayed at a predetermined second point of time after said time frame;

an acceptor configured to detect or accept a physical item, the physical item being associated with a monetary value to establish a credit balance based on the monetary value;

an input device configured to accept a wager, the wager being deducted from the credit balance; and a cashout button configured to initiate a payout from the credit balance to the player.

2. The system of claim 1, wherein the start controller comprises an activator for activating the start signal inputter of the selected gaming terminal and/or a deactivator for deactivating the start signal inputter of all unselected gaming terminals.

3. The system of claim 1, wherein the start controller includes a start signal processor for receiving and processing the start signals of all gaining terminals, said start signal processor configured to identify and forward only the starting signal of the gaming terminal selected for generation of the starting signal and to disregard starting signals of unselected gaming terminals.

4. The system of claim 1, wherein each gaming terminal comprises a displayer responsive to the display signal indicative of the gaming terminal selected for enabling to generate the start signal, wherein the displayer comprises a monitor for displaying an invitation symbol for inviting the player to input the start signal and/or light signaller associated with the start signal inputter.

5. The system of claim 1, further comprising a game server connectable to the ball game device and all gaming terminals, wherein a selector and/or the display signal generator is included in or connected to the game server.

6. The system of claim 1, wherein the gaming terminals comprise communicators for allowing communication of the terminals with each other, wherein a selector and/or the display signal generator are included in or connectable to at least one of the gaming terminals.

7. The system of claim 1, wherein the ball game device comprises a communicator for communicating with the gaining terminals, wherein a selector and/or the display signal generator is included in and/or connectable to the ball game device.

8. The system of claim 1, wherein each of the gaming terminals comprises a display device for displaying the outcome of a game and/or images related to a game as provided by at least one camera, and/or at least one display device for displaying a wagering field including a plurality of wagering fields corresponding to the possible outcomes of a game and allowing for placing a bet and/or a prediction on a specific outcome, wherein the display device comprises a touch screen monitor.

9. The system of claim 1, wherein the ball game device comprises a rotatably supported wheel forming at least a part of the gaming area, wherein the launching mechanism is adapted to launch the ball onto said rotatable wheel.

10. The system of claim 1, wherein the acceptor comprises a bill validator and/or a coin acceptor.

* * * * *